United States Patent [19]

Slautterback

[11] 4,077,725

[45] Mar. 7, 1978

[54] SHOE POLISH APPLICATOR

[76] Inventor: Ernest G. Slautterback, 215 St. David Dr., Mt. Laurel, N.J. 08057

[21] Appl. No.: 690,565

[22] Filed: May 27, 1976

[51] Int. Cl.[2] ..... B43K 27/10; B43K 5/14; B43K 29/00

[52] U.S. Cl. ..... 401/17; 401/132; 401/195; 15/104.94

[58] Field of Search ..... 15/104.94, 228; 401/132, 195, 202, 17

[56] References Cited

U.S. PATENT DOCUMENTS

| | | | |
|---|---|---|---|
| 2,764,774 | 10/1956 | Belsky et al. | 15/228 |
| 2,777,148 | 1/1957 | Belsky et al. | 15/228 |
| 2,846,927 | 11/1974 | Geffin | 401/195 X |
| 2,888,133 | 5/1959 | Betteridge | 15/104.94 |
| 3,082,468 | 3/1963 | Wattles | 15/104.94 |
| 3,806,260 | 4/1974 | Miller | 15/104.94 X |

*Primary Examiner*—Stephen C. Pellegrino

*Attorney, Agent, or Firm*—Tilton, Fallon, Lungmus & Chestnut

[57] ABSTRACT

A shoe polish applicator having a reusable handle-equipped body and a single-use polish-impregnated applicator pad. The pad is normally sealed in a protective wrapper which may be opened to expose the porous surface of the impregnated pad after that pad has been attached to a supporting head portion of the applicator body. Following use of the device, the pad may be ejected from the head portion into any suitable waste receptacle. The steps of attaching the pad to the head portion of the applicator body, the opening of the wrapper, the applying of polish, and the ejecting of the used pad from the applicator body may all be accomplished without touching the polish-releasing surface of the pad with the hands and without applying polish to any surfaces not intended to be so treated. The applicator as disclosed also includes, as part of the handle portion thereof, a hollow cartridge equipped with an applicator tip and containing a suitable liquid for dressing the edges of the soles and heels of shoes.

4 Claims, 3 Drawing Figures

SHOE POLISH APPLICATOR

BACKGROUND

While various devices have been suggested in the past for reducing the effort and mess often associated with the application of paste shoe polishes, such devices have been generally unsuccessful in fully accomplishing those goals or in achieving widespread consumer acceptance. Pre-impregnated applicator pads have been disclosed which are disposable after a single use; however, the pads themselves may be difficult to hold and use without causing some of the polish to come into direct contact with the user's hands. Daubers of various configurations have been marketed, in some cases along with or as part of containers for paste shoe polish but to the extent that such daubers have been reusable, at least until the supply of paste polish in the accompanying containers is exhausted, the likelihood that such reuse might result in polish coming into direct contact with the hands or clothing of users is substantial. Such problems may be less troublesome in the dispensing of liquid polishes rather than paste polishes, since liquids may be totally confined within the body of the applicator and dispensed as needed through the brush or porous dauber portion which extends across the outlet of the unit, but such a device tends more to avoid the problem rather than solve it since there is a continuing demand, and perhaps even a preference for, paste-type shoe polishes.

Patents illustrative of the state of the art are 3,369,267, 3,161,903, 3.006,023 and 2,888,133. Other patents of interest are 2,704,375, 2,755,497, 3,221,356, and 3,412,418.

SUMMARY

This invention is concerned with a shoe polish applicator and its method of use which overcomes the aforementioned defects and disadvantages of prior methods and devices for applying paste shoe polish. Specifically, the applicator of this invention may be easily and conveniently used to apply paste shoe polish (and also, if desired, sole-heel edge dressing) to shoes without the usual problems of inadvertently smearing polish on hands, clothing, and surfaces which are not intended to be treated.

The applicator comprises a single-use pre-impregnated pad and a reusable holder, the holder being equipped with a handle portion which may be readily gripped between the fingers and a head portion for releasably holding the pad. The pad includes a resilient body of porous material such as, for example, a suitable plastic foam, and a relatively stiff backing of generally non-porous material. Sufficient polish in semi-liquid or paste form is carried within the intereconnecting pores or open cells of the foam to treat a pair of shoes. A wrapper formed of foil or other suitable impervious material encloses the foam body and, preferably, extends about the entire pad structure including the backing.

The wrapped pad may therefore be stored for an indefinite period without danger that the polish retained by it will become hard and unmanagable, and may be handled without risk that the polish might be transmitted to the user's hands. In use, the wrapped pad is simply attached to the rigid reusable holder and, following such attachment, the wrapper is then opened, preferably by pulling a tear strip or filament, to expose the surface of the polish-impregnated body of the pad. The polish is then applied to the shoes, the impregnated pad being directed over the shoe surfaces by a user gripping the handle portion of the holder between his fingers, and, when the application is completed, the pad is detached from the holder and discarded. Such detachment is easily accmplished by pushing the stiff backing of the pad through an opening in the head of the holder to disengage the pad from the lugs or other appropriate gripping means provided by the holder.

In the best mode presently known for practicing the invetion, the handle of the reusable holder is formed in sections, one section comprising a tube containing a liquid for dressing the edges of the soles and heels of shoes and having an applicator tip for directing the liquid along such edges. When the liquid is not being applied, the two sections of the handle are joined tightly together to prevent the applicator tip from contacting other surfaces and to prevent evaporation of the liquid from the tip.

Other advantages and objects of the invention will become apparent from the specification and drawings.

DRAWINGS

DETAILED DESCRIPTION

Figure 1:
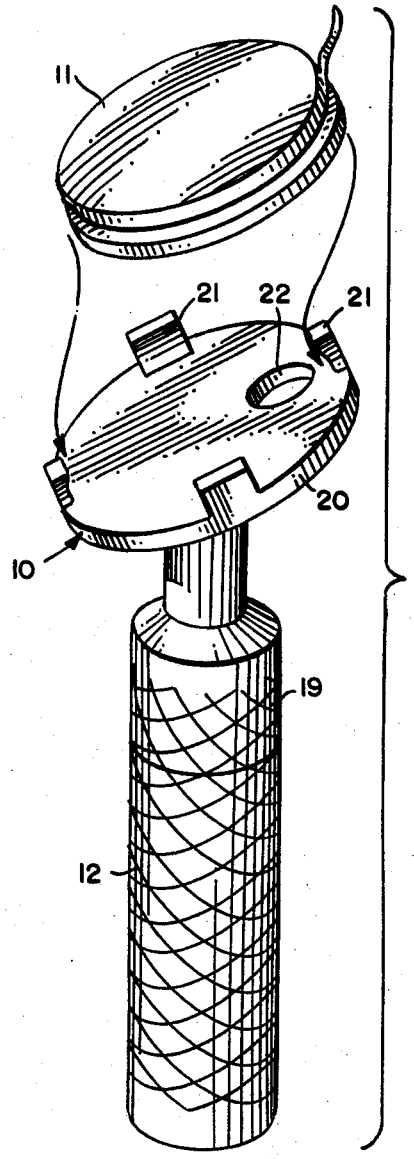
FIG. 1 is a perspective view of an applicator embodying the invention, the applicator pad being shown separated from the holder for clarity of illustration.

Referring to the drawings, the numeral 10 generally designates an applicator comprising a single-use disposable pad 11 and a reusable holder 12. Since the pad is a disposable item, it will be understood that where the assembly is marketed in kit form a multiplicity of pads 11 would be supplied for use with a single holder 12. For purposes of disclosing the operative combination, however, the holder will be described in conjunction with only a single such pad.

Pad 11 includes a resilient porous disc-shaped body 13 and a relatively rigid non-permeable backing 14 secured thereto. The porous body may be formed of an open celled plastic foam, such as a resilient polyurethane foam, or may be composed of a porous woven or non-woven fibrous material. In either event, the pad is impregnated with a paste shoe polish. Since such polishes are conventional and well-known in the art, further description of their characteristics and compositions is believed unnecessary.

Backing 14 takes the form of a disc of relativley stiff non-porous plastic or any other relatively rigid and impermeable sheet material such as, for example, metal or treated cardboard. In the illustration given, the backing 14 is formed as a separate sheet which is secured by adhesive or other suitable means to the foam body 13; however, it is conceivable that the two layers might be formed integrally of the same material, the backing simply being a non-porous "crust" or rear shell of the relatively resilient porous foam layer 13.

The applicator pad 11 is sealed in a wrapper 15 of foil, non-porous plastic film, or fluid-impermeable paper. In the form illustrated in the drawings, the wrapper consists of upper and lower sections **15*a* and 15*b* having flanges 16 and 17 which are sealed together about the circumference of the pad along a line below the upper surface 13***a* of resilient body 13 and above backing 14. A tear strip or ribbon 18 is sealed between the flanges or is otherwise secured within the wrapper, with one end of the strip exposed as shown in the drawings, so that when the strip is pulled the wrapper will tear along a predetermined line to release the wrapper's upper section 15*a* and to expose the upper portion of pad 11.

Figure 2:
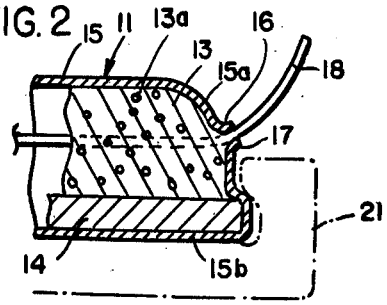
FIG. 2 is an enlarged fragmentary radial sectional view of the pad with the head portion of the holder being illustrated in phantom.
Figure 3:
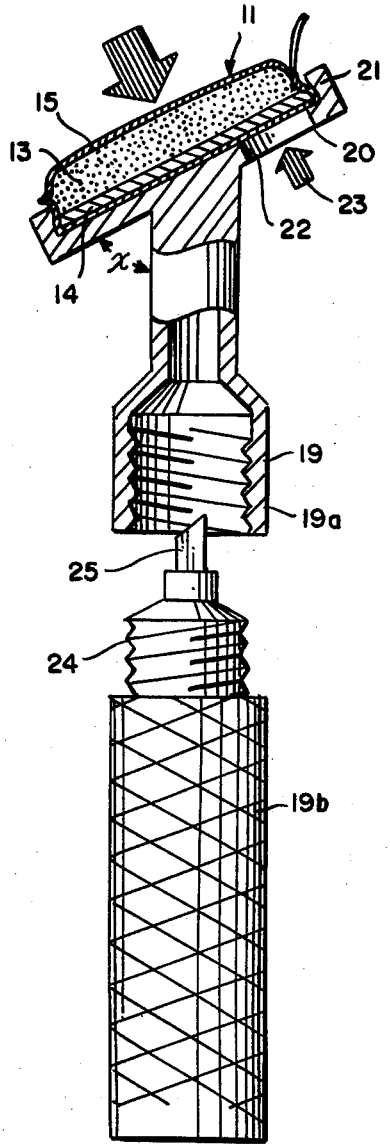
FIG. 3 is a sectional view of the holder and pad with the two sections of the handle being separated to illustrate the relationship of parts more clearly.

Holder 12 includes a handle portion 19 and a head portion 20, the head portion being disc-shaped and equipped with circumferentially-spaced lugs 21 for releasably engaging the rigid backing 14 of the pad as shown in FIGS. 2 and 3. It will be observed that head 20 is canted or tipped with respect to handle 19 to facilitate manipulation of the applicator in use. In the preferred embodiment illustrated, the minimum inside or included angle *x* between the plane of head 20 and the axis of handle 19 is approximately 60°; however, other angles within the range of about 40 to 70° may be nearly as effective.

An opening 22 extends through the most accessible portion of the head 20 and is of sufficient size so that a user may poke his finger into the opening, in the direction indicated by arrow 23 (FIG. 1) to unseat the pad 11 clasped by lugs 21. Since backing 14 is impermeable, and since section 15*b* of the impermeable wrapper remains in place throughout use of the pad, at least in the preferred form of the invention, there is no possibility that polish within the body 13 of the pad will escape rearwardly through the backing and into opening 22 to stain the user's finger when the opening is used to force a spent pad from the holder.

Handle 19 is shown as being formed in two sections 19*a* and 19*b*. The upper section 19*a* not only serves as a stem to support the head 22 with which it is integrally formed, but also is hollowed and internally threaded to provide a cap for lower section 19*b*. The lower section is of generally cylindrical shape, has an externally threaded neck 24 and constitutes a container for holding a liquid dressing of the type commonly used for dressing the edges of the soles and heels of shoes. The threaded neck 24 terminates in an outlet having applicator means 25 for directing and applying the liquid. While such means may take the form of bristles mounted within the opening of the neck, a typical felt applicator tip capable of a wicking action to convey liquid from the container to the point of application is believed particularly effective. Since felt applicators and liquid dressings are well known in the art, further description is believed unnecessary.

It will be noted that the outer surface of handle 19 is shown as being scored or knurled in FIGS. 1 and 3. Such surface treatment is particularly desirable not only because it helps to prevent the applicator from slipping between a user's fingers when the handle is gripped during the application of paste wax and during the application of liquid edge dressing, but also because it helps to prevent slipping of sections 19*a* and 19*b* when those sections are to be separated or connected.

While in the foregoing I have disclosed an embodiment of the invention in considerable detail for purposes of illustration, it will be understood by those skilled in the art that many of these details may be varied without departing from the spirit and scope of the invention.

I claim:

1. A shoe polish applicator comprising a reusable holder having an elongated handle portion and a generally disk-shaped head portion at one end of said handle portion; and a disposable applicator pad removably supported by said head portion; said pad comprising a resilient and generally disk-shaped body of porous material impregnated with a paste shoe polish, a relatively rigid non-porous backing member secured to said body, and a protective wrapper extending over said resilient body to seal the polish therein; and connecting means provided by said head portion embracing said relatively rigid backing member for releasably holding said pad in place; said protective wrapper including a tear strip extending about the periphery of said pad along a line spaced from said backing member and said connecting means for tearing said wrapper to expose the polish-impregnated body of said pad without causing said polish to contact said holder or the fingers of a user; said protective wrapper extending about said body and said backing member to completely enclose said pad, whereby, said protective wrapper is interposed between said head portion and said backing member, and between said connecting means and the surfaces of said body and backing member, when said pad is supported by said holder.

2. The applicator of claim 1 in which said connecting means comprises a plurality of flexible lugs spaced about said head portion and yieldably embracing said relatively rigid backing member of said pad.

3. The applicator of claim 1 in which said head portion includes a finger opening extending therethrough and exposing a portion of the protective wrapper extending over said backing member, whereby, a user may release said pad by inserting a finger through said opening to push said pad away from said head portion.

4. The applicator of claim 1 in which said handle includes a pair of separable sections; one of said sections comprising an elongated container having a liquid therein for use in dressing the edges of soles and heels of shoes and being provided with an applicator tip for applying said liquid; the other of said handle sections comprising a protective removable cap for said container section.

* * * * *